US006327919B1

(12) United States Patent
Allouche et al.

(10) Patent No.: US 6,327,919 B1
(45) Date of Patent: Dec. 11, 2001

(54) METHOD FOR TAKING A SOIL SAMPLE FROM A HORIZONTAL BOREHOLE

(76) Inventors: Erez Nissim Allouche, 592 Wolf Willow Road, Edmonton, Alberta (CA), T5T 1E6; Samuel Thevasagayam Ariaratnam, #315, 17109 - 67 Avenue, Edmonton, Alberta (CA), T5T 6E6; Kevin William Biggar, 125 Dufferin Street, St. Albert, Alberta (CA), T8N 6G7; Casey Edwin Como, 9128 - 141 Street, Edmonton, Alberta (CA), T5R 0L4

( * ) Notice: Subject to any disclaimer, the term of this patent is extended or adjusted under 35 U.S.C. 154(b) by 0 days.

(21) Appl. No.: 09/295,144

(22) Filed: Apr. 20, 1999

(30) Foreign Application Priority Data

Apr. 20, 1998 (CA) ..... 2.235196

(51) Int. Cl.[7] ..... E21B 49/08
(52) U.S. Cl. ..... 73/864.44
(58) Field of Search ..... 73/863.31, 864.44, 73/864.45, 864.51, 151.09, 151.11, 151.54, 151.23–151.26; 175/58, 59, 20; 166/250.01, 264

(56) References Cited

U.S. PATENT DOCUMENTS 3,630,296 * 12/1971 Bullard et al. .
4,542,796 9/1985 Delbarre ..... 175/19
4,694,913 9/1987 McDonald et al. ..... 175/61
4,858,704 8/1989 McDonald et al. ..... 175/61
5,033,556 7/1991 Panzke ..... 175/62
5,310,013 * 5/1994 Kishino et al. .
5,358,057 10/1994 Peters et al. ..... 175/20
5,377,754 * 1/1995 Keller .

OTHER PUBLICATIONS

Ditch Witch Environmental Systems product brochure entitled "Horizontal Soil Sampler", 3 pages, undated.

Eastman Christensen Environmental Systems product brochure for the "PunchMaster 2000 Core Barrel", 1 page, undated.

* cited by examiner

*Primary Examiner*—Robert Raevis
(74) *Attorney, Agent, or Firm*—Christensen O'Connor Johnson Kindness PLLC

(57) ABSTRACT

A method for taking soil samples from horizontal boreholes. A first step involves making a substantially horizontal borehole from an entry pit to an exit pit. A second step involves towing a soil sampling apparatus through the borehole. It is preferred that the apparatus be pulled by the drill string as the drill string is withdrawn from the borehole. By using a soil sampling apparatus that is capable of taking multiple soil samples, all necessary soil sampling along the horizontal borehole may be completed in a single pass.

11 Claims, 7 Drawing Sheets

METHOD FOR TAKING A SOIL SAMPLE FROM A HORIZONTAL BOREHOLE

FIELD OF THE INVENTION

The present invention relates to a method for taking a soil sample from a horizontal borehole.

BACKGROUND OF THE INVENTION

The need to develop improved soil sampling techniques for horizontally drilled boreholes has become apparent by the increasing use of horizontal drilling to characterize soil at contaminated sites and on linear projects such as tunnels. Horizontal boreholes are presently used for installing utility lines, such as gas lines, electrical or communications conduit and the like. When using horizontal boreholes to characterize sites they provide some obvious advantages over vertical drilling. With vertical drilling, the drilling rig must be positioned directly above the location from which samples are to be taken. With horizontal drilling samples can be taken by extending a borehole horizontally underneath rivers, structures, highways, or environmentally sensitive areas. In addition, vertical drilling is associated with the risk of penetrating impermeable layers, potentially causing crosscontamination between aquifers. This risk can be avoided by horizontal drilling technology.

There are two soil samplers presently in use in conjunction with horizontal directional drilling. One soil sampler is being produced under the Trademark PunchMaster 2000 Core Barrel, by Eastman Christensen Environmental Systems corporation. This soil sampler c onsists of an inner barrel which is encased in an outer tube. The sampler works on a principal similar to a split-spoon or a Shelby Tube core sampler. First a horizontal borehole is drilled up to the target area. The drill string is than withdrawn from the borehole and the boring head is replaced with the sampling tool. The PunchMaster 2000™ is advanced into the borehole to the target area while the load on the outer tube is kept constant with an applied hydraulic pressure. At a predetermined location an inner tube is accelerated into the formation by hydraulic pressure. The sample is then drawn back into the outer tube while pressure on the outer tube is maintained to prevent drilling media from contaminating the sample, and the PunchMaster is brought to the surface. This process is repeated for each sample. Another soil sampler is being produced under the by DitchWitch Environmental Systems corporation, located in Perry Okla. This soil sampler consists of a long metal tube with a spring loaded cone-shape cap. A pilot bore is drilled to a distance of approximately 0.3–0.6 of a meter (1 to 2 ft) from the target area. The drill string is then retracted, the cutting head removed, and a soil sampler is connected to the end of the drill string. The sampler is pushed through the bore, then continued to be pushed through the undisturbed soil until the target area is reached. The drill string is retracted approximately 0.46 of a meter (18 inches), and the sampler tube is automatically locked in open position. The sampler is pushed forward 0.3 to 0.6 of a meter (1 to 2 ft), filling the tube with soil. The sampler and drill string are then removed from the bore. The sampling tube is removed and replaced with the drilling head, and the process is repeated.

One disadvantage of both the PUNCHMASTER 2000™ and the DITCHWITCH™ soil samplers is that the sample must be collected ahead of the drilling bit. To facilitate this the drill string is withdrawn from the borehole and the drill bit is removed in order to attach the soil sampler. A sample is then taken, the drill string is withdrawn from the borehole and the soil sampler is recovered, then the drill bit is reattached in order to drill to the next target location. This requires the entire length of the drill string to be removed from the borehole twice for every sample that is taken. In addition, for contaminated site assessment the soil sampler must be de-contaminated between successive samples to avoid cross-contamination.

SUMMARY OF THE INVENTION

What is required is a less time consuming method for taking a soil sample from a horizontal borehole.

According to the present invention there is provided a method for taking soil samples from horizontal boreholes. A first step involves making a substantially horizontal borehole from an entry pit to an exit pit. A second step involves towing a soil sampling apparatus through the borehole.

The method, as described above, represents a radical departure from the teachings in the prior art. Instead of disrupting the drilling process by requiring the drill string to be withdrawn from the borehole, the soil sampling apparatus is pulled through the borehole after the drilling has been completed. The soil sampler can be pulled through the horizontal borehole from the exit pit to the entry pit, or vice versa, by a variety of mechanical means.

Although beneficial results may be obtained through the use of the method, as described above, it is preferred that the soil sampling apparatus be pulled back through the borehole from the exit pit to the entry pit by the drill string as the drill string is withdrawn from the borehole. The drilling drill string must always be withdrawn from the borehole upon completion of the drilling process. Collecting samples during the pull-back operation rather than during the forward drilling operation not only eliminates disruption of the drilling process, it conveniently incorporates the sampling procedure into existing drilling procedures. The sampling procedure, therefore, does not involve any additional steps that would increase the cost of drilling the borehole. This represents a significant cost saving over the prior art.

Although beneficial results may be obtained through the use of the method, as described above, even more beneficial results may be obtained when the soil sampling apparatus used includes means for taking more than one soil sample. The pulling of the soil sampling apparatus through the borehole can be temporarily halted at spaced intervals along the borehole in order to take soil samples at such spaced intervals. This allows all necessary soil sampling along the horizontal borehole to be completed in a single pass.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1:
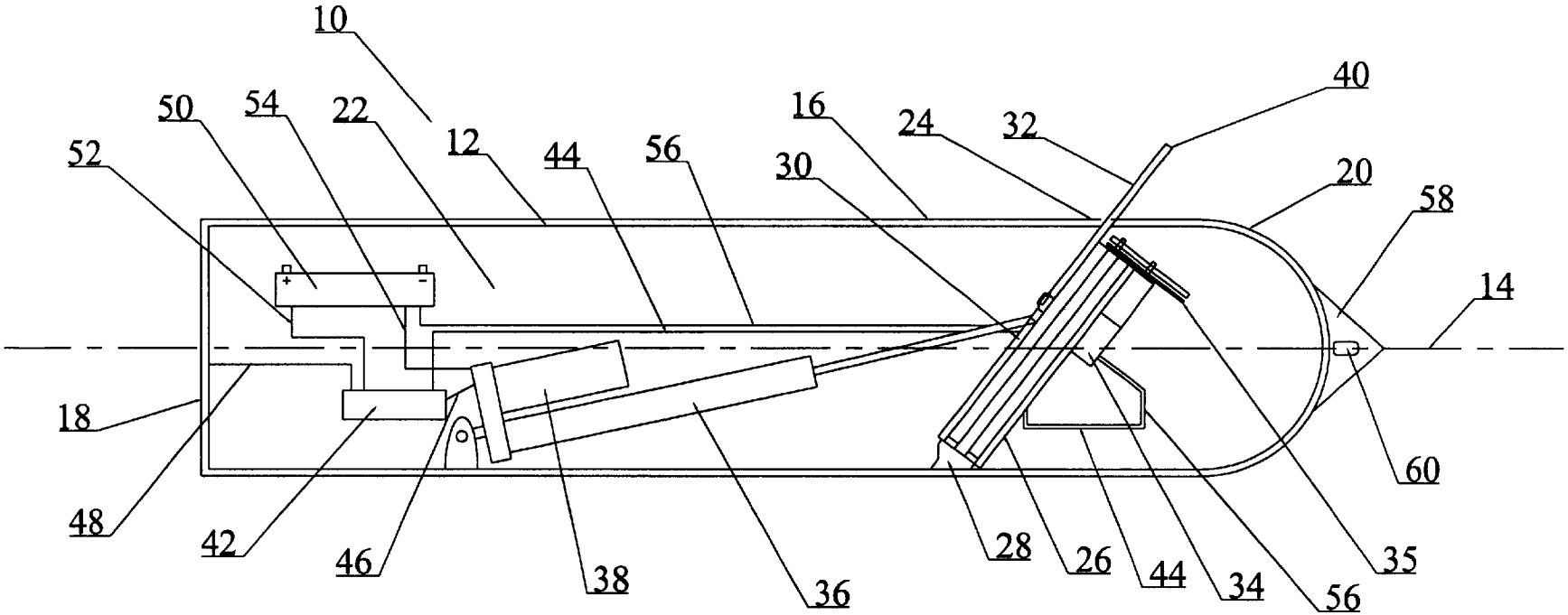
FIG. 1 is a side elevation view, in section, of a soil sampler constructed in accordance with the teachings of the present invention, with the actuator pushing a selected sample container to the extended sample collecting position.

The preferred embodiment, a soil sampler generally identified by reference numeral 10, will now be described with reference to FIGS. 1 through 7.

Figure 2:
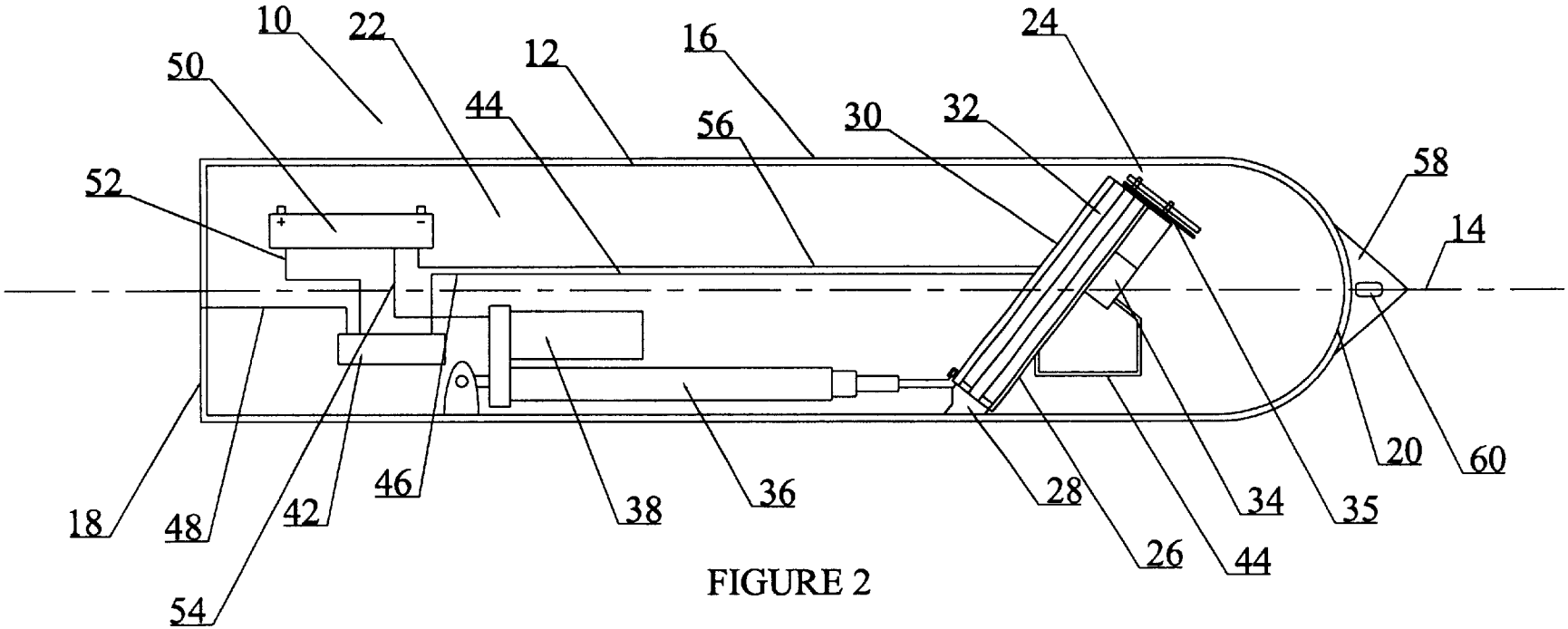
FIG. 2 is a side elevation view, in section, of a soil sampler constructed in accordance with the teachings of the present invention, with the actuator holding a selected sample container in the retracted rest position.
Figure 3:
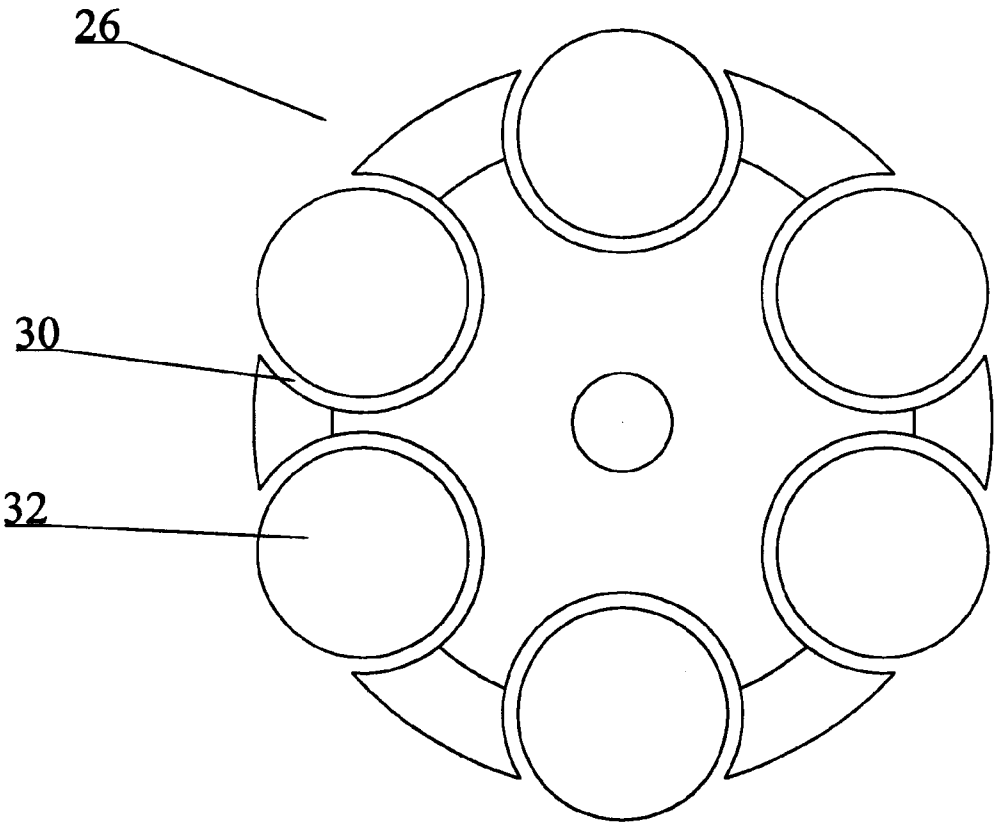
FIG. 3 is a transverse section view of the sample container support cylinder of the soil sampler illustrated in FIGS. 1 and 2.

Referring to FIGS. 1 and 2, soil sampler 10 has a hollow cylindrical housing 12 with a longitudinal axis, generally indicated by reference numeral 14. Housing 12 has a peripheral sidewall 16, a rear end wall 18 and a front end wall 20 that define an interior cavity 22. A sampling port 24 extends through peripheral sidewall 16. A cylindrical container support 26 is rotatably mounted on a base 28 within interior cavity 22. Base 28 is offset at an angle to longitudinal axis 14. The preferred angle is in a range of between 30 degrees and 45 degrees. Referring to FIG. 3, container support 26 has a plurality of sample container retaining chambers 30. There is provided a plurality of tubular sample containers 32. One of sample containers 32 is positioned in each of sample container retaining chambers 30 of container support 26. Referring to FIGS. 1 and 2, a stepper motor 34 is provided for rotating container support 26 until one of sample container retaining chambers 30 for a selected sample container 32 is aligned with sampling port 24. Associated with the operation of stepper motor 34 are drive gears 35. A worm-gear driven actuator 36 is positioned within interior cavity 22 of housing 12 for moving the selected sample container 32 between an extended sample collecting position illustrated in FIG. 1 and a retracted rest position illustrated in FIG. 2. In the illustrated embodiment, the worm-gear actuator 36 is electric and has an associated electric motor 38. Referring to FIG. 1, in the extended sample collecting position a remote end 40 of the selected sample container 32 extends through sampling port 24 at an angle to longitudinal axis 14. The angle is determined by the angular positioning of base 28. Referring to FIG. 2, in the retracted rest position the selected sample container 32 is wholly within interior cavity 22 of housing 12. A control processing unit (CPU) or microprocessor 42 is also positioned within interior cavity 22 of housing 12. Microprocessor 42 is connected by wires 44 to stepper motor 34 and by wires 46 to electric motor 38. Microprocessor accepts signals relayed by wireline 48. Batteries 50 provide a source of power to stepper motor 34, electric motor 38 and microprocessor 42. Electrical batteries 50 are connected to Microprocessor 42 by wires 52, to electric motor 38 by wires 54 and to stepper motor 34 by wires 56.

Figure 4:
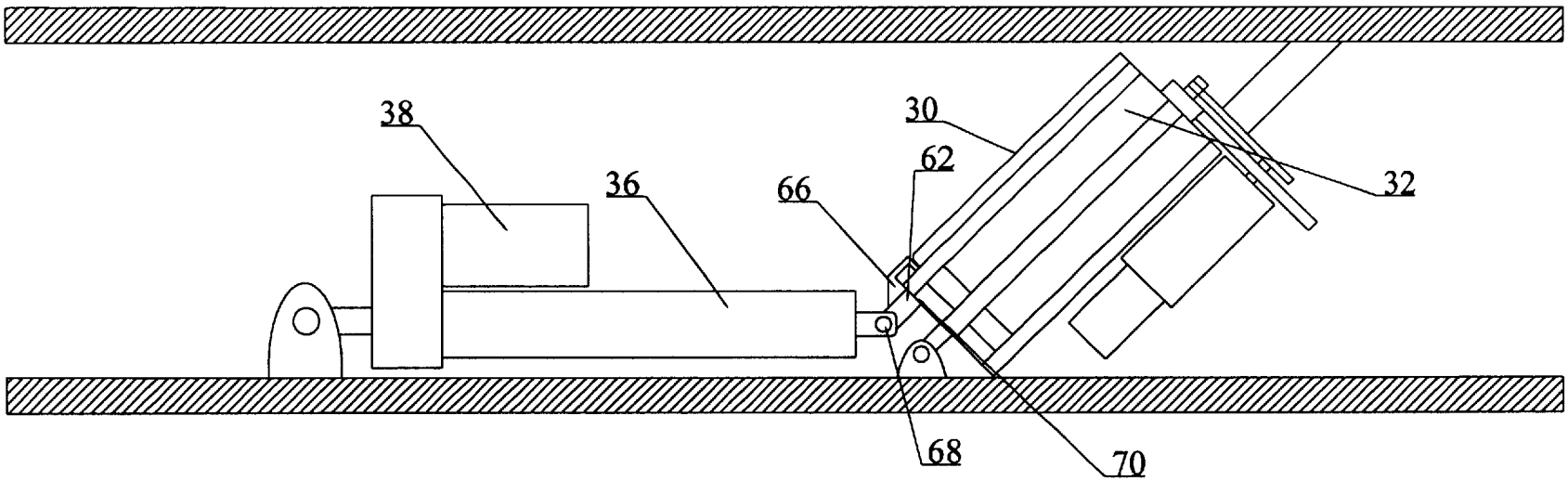
FIG. 4 is a side elevation view of the soil sampler illustrated in FIGS. 1 and 2, showing the connection between the remote end of the actuator and the sampling tube.
Figure 5:
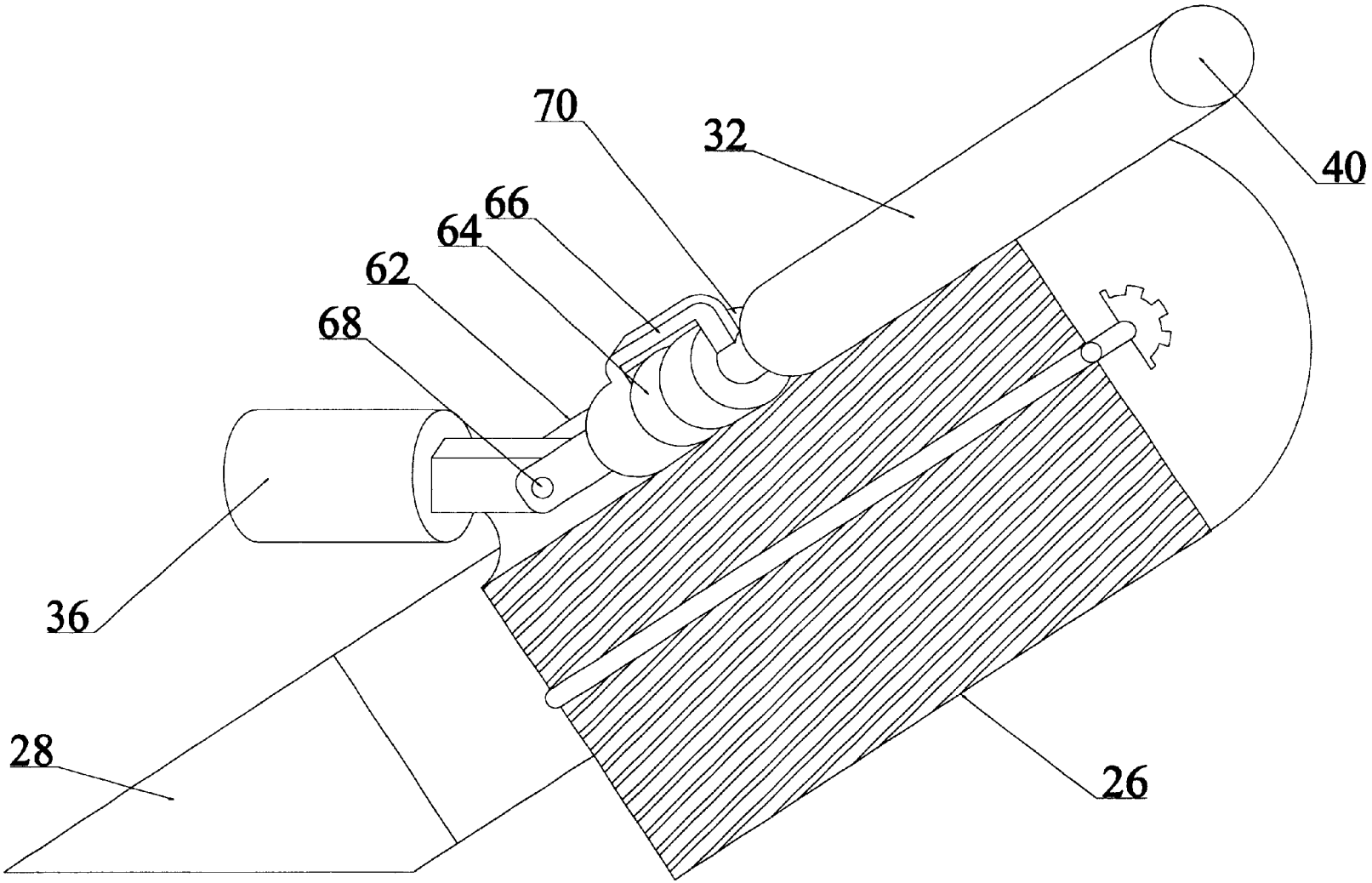
FIG. 5 is a detailed side elevation view of the soil sampler illustrated in FIG. 4 showing the connection between the remote end of the actuator and the sampling tube.

Referring to FIGS. 4 and 5, an end piece 62 is attached to the remote end of the actuator 36 to facilitate the extension and retraction of the tubular sample container 32. The end piece 62 consists of two components, a conical rod 64 and a hook 66, and is attached to the remote end of the actuator by the mean of a pin 68. The end of hook 66 sits in a groove 70 in sampling tube 32. When actuator 36 is extended, conical rod 64 engage the back of sample container 32 pushing it forwards and upwards along sample container retaining chamber 30 which acts as a guiding conduit. Referring to FIG. 1, sample container 32 is aligned with sampling port 24 and upon extension of actuator 36 is pushed to the extended position. When the actuator 36 has been extended to its maximum length it stops. When actuator 36 retracts sample container 32 to drawn to the retracted position by the mean of hook 66 which engages groove 70 of sampling container 32. Referring to FIGS. 1 and 2, housing 12 has a pulling head 58 secured to front end wall 20. A pulling eye 60 is located within pulling head 58 and is used as a means to connect the soil sampler 10 to the drill string or a cable, as will hereinafter be further described in relation to the use and operation of soil sampler 10.

Figure 6:
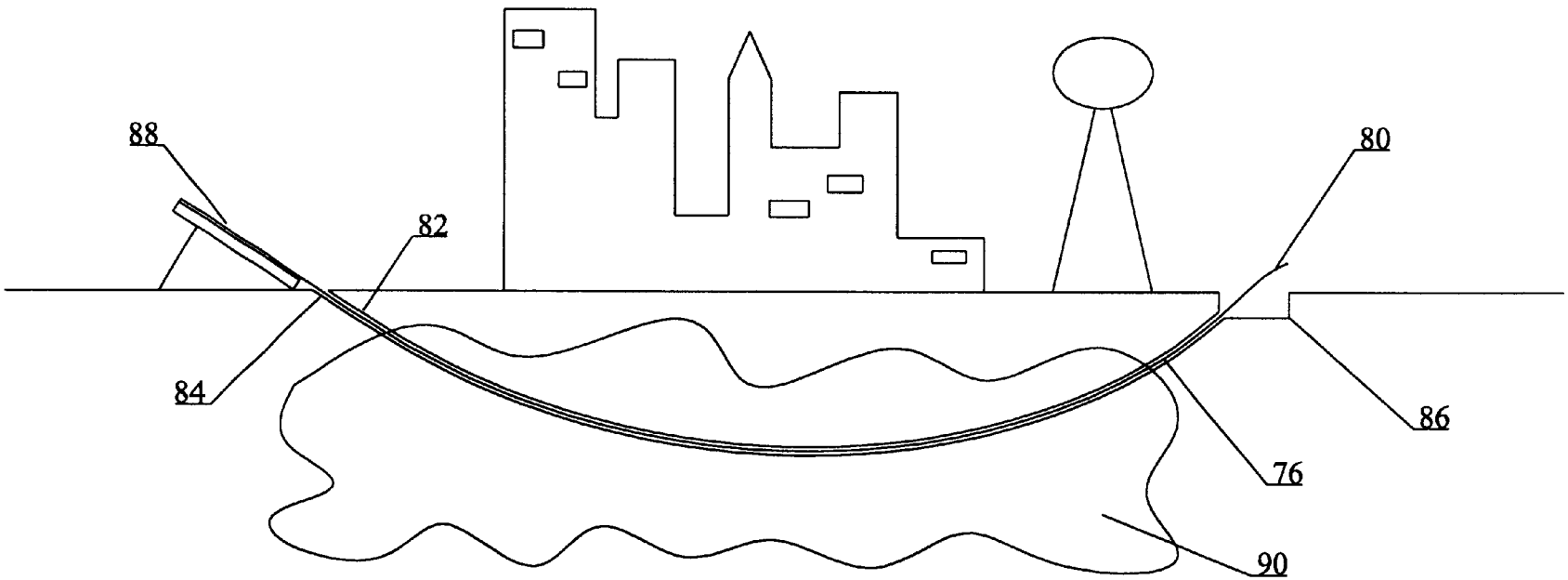
FIG. 6 is a side elevation view, in section, showing a first of a two-stage sampling process.
Figure 7:
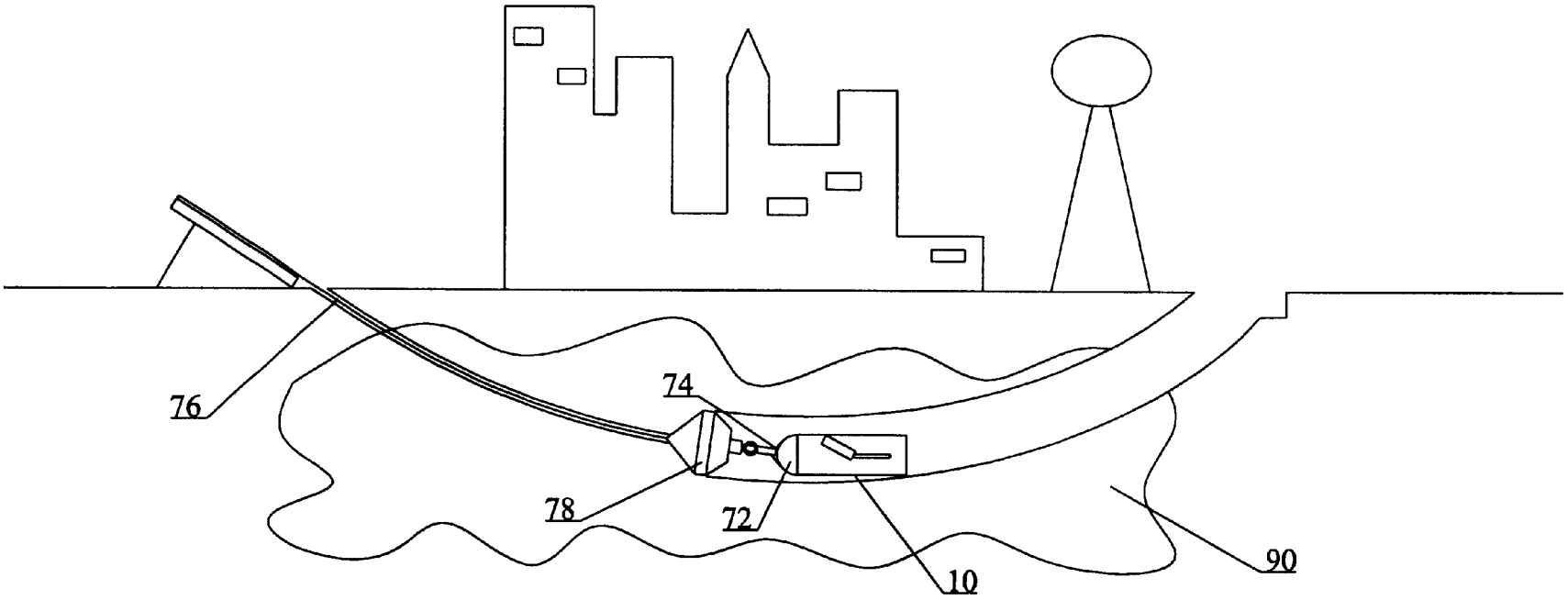
FIG. 7 is a side elevation view, in section, showing a second of a two-stage sampling process with the preferred manner in which the soil sampler is to be advanced from one sampling location to the next.

The use and operation of soil sampling apparatus 10 will now be described with reference to FIGS. 1 through 7. Referring to FIG. 6 a drilling bit 80 connected to a drill string 76 is used to create a borehole 82 that extends from an entry pit 84 to an exit pit 86. Upon borehole 82 being completed, drilling bit 80 is removed and soil sampler 10 is connected to drilling string 76. Soil sampler 10 is then pulled-back along borehole 82 from exit pit 86 towards entry pit 84 by a drilling rig 88 (or another mechanical means) across a soil sampling target area, generally indicated by reference numeral 90. Soil sampler 10 is connected to drill string 76 by the means of a backreamer 78, which enlarges borehole 82 to a diameter slightly larger than the diameter of the soil sampler 10. Periodically during the pullback process, the pullback operation is temporarily discontinued in order to permit a soil sample to be taken. Referring to FIG. 1, a signal is sent to microprocessor 42 via wireline 48. Upon receiving the signal from wireline 48, microprocessor 42 activates stepper motor 34 to rotate container support 26 to select an unused sample container 32. Actuator 36 is then activated to move the selected sample container 32 to the extended sample collecting position. Referring to FIG. 2, once the sample has been taken a signal is sent to microprocessor 42 via wireline 48 causing microprocessor 42 to activate actuator 36 to move the selected sample container 32 back into the retracted rest position so that the pullback operation may resume. When a further sample is desired the pull back operation is again temporarily discontinued to allow the further sample to be taken. Referring to FIG. 1, a signal is again sent to microprocessor 42 via wireline 48. Upon receiving the signal from wireline 48, microprocessor activates stepper motor 34 to rotate container support 26 to select the next unused sample container 32. Actuator 36 is then activated to move the selected sample container 32 to the extended sample collecting position. Referring to FIG. 2, once the sample has been taken a signal is sent to microprocessor 42 via wireline 48 causing microprocessor 42 to activate actuator 36 to move the selected sample container 32 back into the retracted rest position so that the withdrawal of the drilling string may again resume.

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. A method for taking soil samples from horizontal boreholes, comprising the steps of:

firstly, making a substantially horizontal borehole from an entry pit to an exit pit with a drill string; and secondly, pulling a soil sampling apparatus back through the borehole from the exit pit to the entry pit with the drill string as the drill string is withdrawn from the borehole.

2. The method as defined in claim 1, wherein the soil sampling apparatus includes means for taking more than one soil sample and the pulling of the soil sampling apparatus through the borehole is temporarily halted at spaced intervals along the borehole in order to take soil samples at such spaced intervals.

3. A method for taking soil samples from horizontal boreholes, comprising the steps of:

providing a soil sampling apparatus capable of taking several soil samples;

making a substantially horizontal borehole from an entry pit to an exit pit using a drill bit at the end of a drill string;

connecting the soil sampling apparatus to a remote end of the drill string that is accessible from the exit pit;

pulling the soil sampling apparatus back through the borehole from the exit pit to the entry pit with the drill string as the drill string is withdrawn from the borehole; and halting the pulling of the soil sampling apparatus back through the borehole temporarily at spaced intervals along the borehole in order to take a soil sample at each of such spaced intervals.

4. The method as defined in claim 3, the soil sampling apparatus including:

a hollow cylindrical housing having a longitudinal axis, the housing having a peripheral sidewall and end walls that define an interior cavity;

at least one sampling port extending through the peripheral sidewall;

a plurality of sample containers positioned on a container support within the interior cavity of the housing;

means for selecting one of the plurality of sample containers;

means for moving the selected one of the plurality of sample containers between an extended sample collecting position and a retracted rest position, in the extended sample collecting position a remote end of the selected one of the plurality of sample containers extends through the at least one sampling port at an angle to the longitudinal axis, in the retracted rest position the selected one of the plurality of sample containers is wholly within the interior cavity of the housing.

5. The method as defined in claim 4, wherein the container support is a rotatably mounted cylinder having a plurality of sample container retaining chambers.

6. The method as defined in claim 5, wherein the means for selecting one of the plurality of sample containers includes a motor for rotating the rotatably mounted container support cylinder until one of the plurality of sample container retaining chambers is aligned with the at least one sampling port.

7. The method as defined in claim 4, wherein the means for moving the selected one of the plurality of sample containers between the extended sample collecting position and the retracted rest position is an actuator positioned within the interior cavity of the housing.

8. The method as defined in claim 7, wherein guide means are provided on the container support for guiding a remote sample container engaging end of the actuator.

9. The method as defined in claim 7, wherein remotely actuatable control means are provided within the interior cavity of the housing.

10. The method as defined in claim 4, wherein means is provided at a front end of the housing to secure the housing to means for pulling the housing through a horizontal borehole.

11. The method as defined in claim 10, wherein the housing has a pulling eye on a front end wall.

* * * * *